United States Patent [19]

Langston

[11] Patent Number: 4,967,048

[45] Date of Patent: Oct. 30, 1990

[54] SAFETY SWITCH FOR EXPLOSIVE WELL TOOLS

[76] Inventor: Thomas J. Langston, 503 Caliente, New Iberia, La. 70560

[21] Appl. No.: 483,355

[22] Filed: Feb. 22, 1990

Related U.S. Application Data

[63] Continuation-in-part of Ser. No. 231,342, Aug. 12, 1988, abandoned.

[51] Int. Cl.[5] ..... E21B 43/116; F42C 15/00; H01H 35/38

[52] U.S. Cl. ..... 200/334; 89/1.015; 200/61.069; 200/51.010; 200/336; 200/570; 166/55.001; 175/4.056; 175/2; 361/62

[58] Field of Search ..... 200/308, 334, 51.09, 200/51.1, 51.11, 51.12, 51.14, 61.50 R, 336, 507, 570, 572; 174/2, 5 R, 71 C; 102/312, 313; 166/67, 65.1, 72, 55, 55.1; 175/4.56, 2; 89/1.15; 361/62, 63, 66, 107, 117

[56] References Cited

U.S. PATENT DOCUMENTS

| | | | |
|---|---|---|---|
| 2,785,631 | 3/1957 | Blanchard | 89/1.15 X |
| 2,837,995 | 6/1958 | Castel | 89/1.15 X |
| 3,168,141 | 2/1965 | Lebourg | 175/4.56 X |
| 3,758,731 | 9/1973 | Vann et al. | 200/61.69 |
| 4,011,815 | 3/1977 | Garcia | 166/55.1 X |
| 4,154,302 | 5/1979 | Cugini | 166/315 |
| 4,266,613 | 5/1981 | Boop | 166/299 |
| 4,314,614 | 2/1982 | McPhee et al. | 175/4.56 |
| 4,523,650 | 6/1985 | Sehnert et al. | 175/4.56 |
| 4,561,356 | 12/1985 | Bordon | 166/55.1 X |

*Primary Examiner*—Ernest G. Cusick
*Attorney, Agent, or Firm*—Dodge Bush & Moseley

[57] ABSTRACT

In accordance with illustrative embodiments of the present invention as disclosed herein, a safety switch for preventing accidental firing of an explosive well tool includes a tubular metal body connected between the cable head and the well tool, a conductor wire extending through such body for carrying current from the cable to the well tool, and a contact plug mounted in a slide opening in the body and arranged to be selectively advanced into shorting contact with the conductor wire.

27 Claims, 2 Drawing Sheets

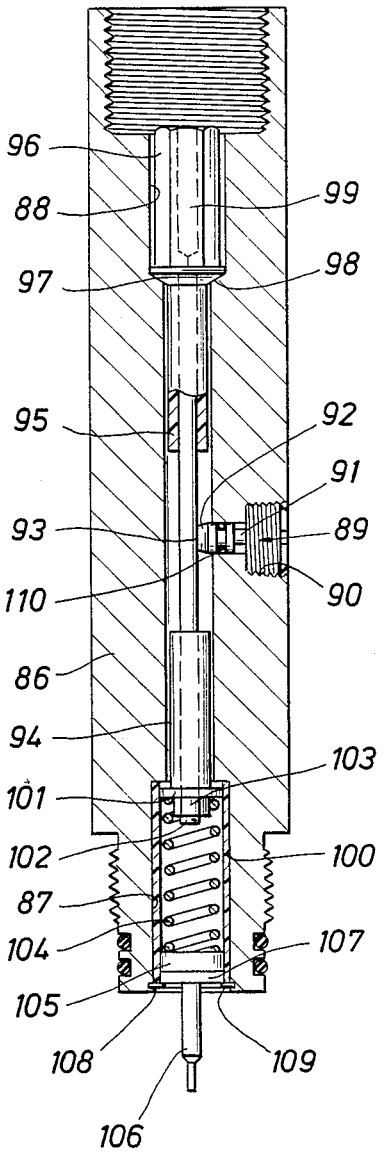
FIG. 6
FIG. 7
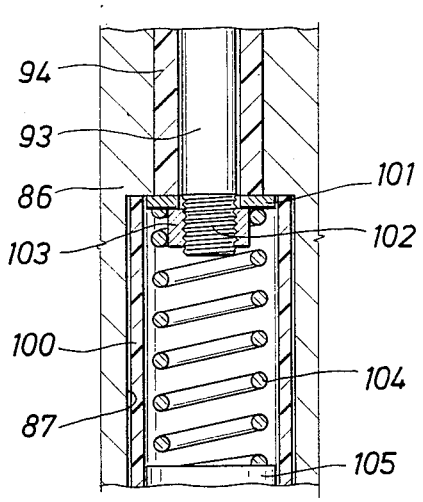
FIG. 8
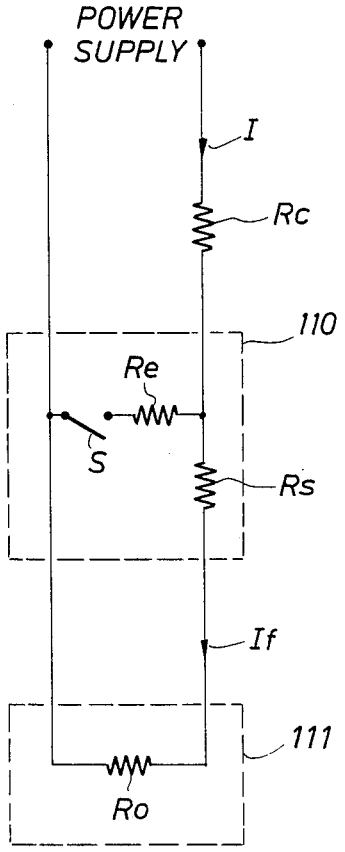

SAFETY SWITCH FOR EXPLOSIVE WELL TOOLS

CROSS-REFERENCE TO RELATED APPLICATION

This application is a continuation-in-part of application Ser. No. 231,342 filed Aug. 12, 1988, now abandoned.

FIELD OF THE INVENTION

This invention relates generally to explosive well tool safety devices, and particularly to a new and improved bypass safety switch that can be activated to greatly reduce the possibility of accidental firing of an explosive well tool until it has been lowered below the rig floor or other area where personnel may be present.

BACKGROUND OF THE INVENTION

Serious accidents resulting in personal injury, maiming, and loss of life have occurred de to premature detonation of various explosive wireline tools such as perforating guns, casing or tubing cutters, string shot rods, jet cutters and the like. All such devices include powerful explosives that are extremely dangerous and which must be handled with great care. Even though great care is exercised, there still have been instances where premature firing has occurred after assembly of the tool onto the end of the cable, and before it has been inserted in the well. It is believed that such accidental firing can have many causes. For example, stray currents due to power leakage from defective wiring, generators, motors, electric welders and the like can be the cause. Other causes may be static charges produced by dust and electrical storms in the area, and by certain other atmospheric conditions. Ground currents produced by lightning, power lines, and galvanic action due to different soil strata can cause detonation. Some accidents have been thought to be due to operation of mobile, two-way communication equipment in the area.

There has been a continued and long-felt need for a safety device that will greatly reduce the possibility of accidental firing of the explosive due to causes such as those enumerated above. Injury to personnel most often occurs when the explosive goes off at the surface, either while rigging the tool up, or while the tool is being placed in the casing or tubing.

The general object of the present invention is to provide a new and improved bypass safety switch that will prevent premature firing of an explosive well tool.

Another object of the present invention is to provide a new and improved safety switch that functions to prevent flow of enough electric current to the detonator fuse of an explosive wireline tool to fire the same while the tool is being handled at the surface, and until it has been positioned well below the rig floor where service personnel might be present.

SUMMARY OF THE INVENTION

These and other objects are attained in accordance with the concepts of the present invention through the provision of a bypass safety switch apparatus which preferably is installed between the electric wireline cable head and the upper end of the body of the explosive tool. The switch apparatus includes a tubular metal body having a hollow interior and a side opening through the wall thereof. One end of the body has means for connecting it to a cable head to which the electric wireline is attached, and the other end of the body is provided with means for connecting to the body of the explosive tool. An insulated conductor which couples electrical signals from the cable to the tool extends through said interior past said opening. The conductor has at least a portion of its insulation removed at a location, for example, opposite said opening to provide a bare surface area.

An electrical contact in the form of a metal contact member is mounted on said body for movement between a first position out of contact with said bare surface area, and a second position in contact therewith. When in the first or "closed" position, the contact plug shorts the conductor to the body, and thus to the armor wires of the cable. Since the detonator normally included in the explosive tool has a known finite electrical resistance, current flowing toward the tool from the cable will be shorted to ground via the contact plug, the switch body and the cable armor wires. When the switch is placed in the second or "open" position, the explosive tool can be operated in the usual manner.

The bypass switch of the present invention is placed in the "closed" position and attached to either the tool body or the cable head before the complete rig-up is made, and is left in the "closed" position until the tool has been lowered into the upper section of the well conduit, which may be casing, tubing or drill pipe. At this point the explosive portion of the tool will be well below the rig floor where personnel may be standing. When the switch body is just above the upper end of the conduit, the operator, using an appropriate instrument such as an allen wrench or screwdriver in the case of some embodiments, can position the switch in its "open" position by rotating and retracting the contact plug so that it no longer engages the bare portion of the conductor within the body passage. Until this has been done, it is not possible in most cases for the explosive tool to be fired, whether intentionally, or accidentally as discussed above. Thus the safety of using explosive well tools is greatly enhanced, and the risk of injury reduced to nil.

The physical construction of the bypass switch assembly and its various component parts can take various forms, and several embodiments are disclosed in detail herein. The invention has other objects, features and advantages which will become more fully apparent in connection with the following detailed description, taken in conjunction with the appended drawings.

BRIEF DESCRIPTION OF THE DRAWINGS

FIG. 6 is a longitudinal sectional view of a fourth embodiment of the present invention;

FIG. 7 is an enlarged view of the upper end portion of the embodiment of the switch assembly shown in FIG. 6; and FIG. 8 is an electrical schematic diagram of the overall circuit in which the present invention is used.

DETAILED DESCRIPTION OF PREFERRED EMBODIMENTS

Figure 1:
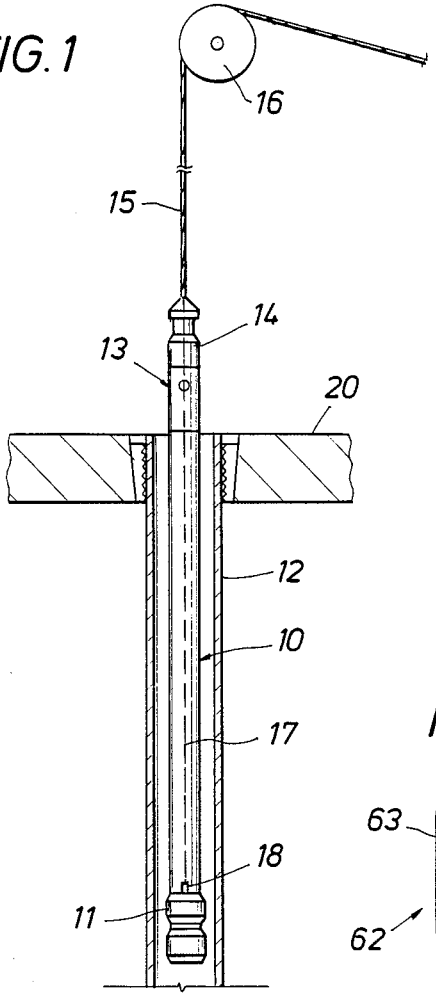
FIG. 1 is a somewhat schematic view of the top of a well with an explosive tool being lowered therein.

Referring initially to FIG. 1, a wireline tool 10 that includes an explosive device 11 on its lower end is shown being lowered into a well conduit 12, which may be casing, tubing, or drill pipe. A bypass safety switch assembly 13 in accordance with the present invention is attached between the uppermost end of the body of the tool 11 and a cable head 14 to which the electric wireline 15 is attached. The wireline 15 extends upward and over a sheave 16, and then outward to the winch of a service truck (not shown). Typically, the wireline 15 that is used for running explosive tools is a monocable that has a single insulated conductor wire in the center of a core, and around which metal armor wires are laid to provide tensile strength. The conductor is coupled through a collector ring and brush arrangement on the winch spool to a power circuit in the truck, such circuit being provided with a normally open firing switch that is turned on when it is desired to fire the explosive charge carried in the tool 10. As shown in dotted lines in FIG. 1, the conductor wire 17 extends from the cable 15 down through the tool 10 to a detonator fuse 18 for the explosive charge 11. The tool body and the armor wires of the cable provide a ground return for current in conductor wire 17. The wireline tool 10 is shown as having been lowered into the top of the well conduit until the safety switch 13 is located just above the rig floor 20. The tool 10 is then stopped where the switch 13 is still accessible to operating personnel. At such location, the explosive charge 11 is well below the rig floor 20, so that even if the charge were to be accidentally fired at this time, most personnel on the floor would be out of harm's way.

Figure 2:
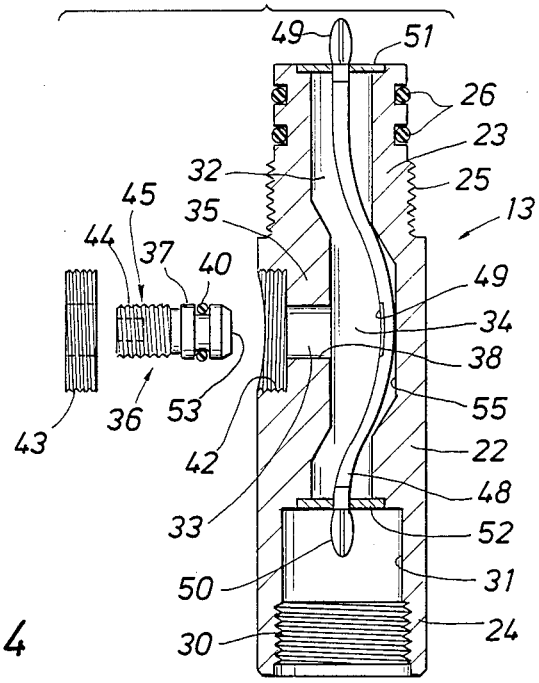
FIG. 2 is a longitudinal, sectional exploded view of one embodiment of the present invention with the contact plug and adapter bushing removed and shown in side elevation.

A first embodiment of the present invention is shown in FIG. 2. The switch assembly 13 includes a tubular, metallic body 22 having a male end portion 23 and a female end portion 24. The male portion 23 has a reduced outer diameter provided with external threads 25 and seal rings 26 which are used to provide a leak-proof connection of the body 22 with the upper end of the body of the well tool 10. Of course the cable head 14 has a female arrangement of threads and seal surface that preferably is identical to that of the lower end portion 23 of the switch body 22.

The body 22 has an internal passage 32 that is intersected by a radial opening 33 through the wall of the body. The central region 34 of the passage 32 can be laterally offset toward the side of the body 22 to provide a region 35 of increased wall thickness which surrounds the side opening 33. A metal contact plug 36 has an inner section 37 that is arranged to be received in a reduced diameter inner portion 38 of the opening 33. An external groove in the outer wall of the inner section 37 carries an O-ring seal 40 which sealingly engages the wall of the opening 38 to prevent fluid leakage. The enlarged diameter outer portion 42 of the opening 33 is threaded, as shown, to receive an annular adapter ring 43 having a central bore (shown in dash lines) which is threaded to receive the companion threads 44 on the outer section 45 of the contact plug 36. The threads 44 and the internal threads on the adapter 43 provide one embodiment of an axial cam means. The outer end surface of the plug 36 is provided with a suitable recess such as a diametrical slot, or a depression having polygonal walls, so that a suitable instrument such as a screwdriver or an allen wrench can be employed to turn the plug and advance it radially inward or outward with respect to the longitudinal axis of the body 22.

A section of the conductor wire 48 extends in a slack manner through the passage 32. The opposite ends of the wire 48 are electrically connected to suitable connectors, such as banana pins 49 and 50, which can be mounted on non-conductive discs or plates 51, 52 fixed at the respective opposite ends of the passage 32. When assembled together with the cable head 14 and the body of the tool 10, the conductor wire 48 forms a section of the wire 17 shown in dash lines in FIG. 1. At a location on the wire 48 directly opposite the opening 22, a portion of the insulation is removed from that side of the wire which faces the end surface 53 of the contact plug 36. Thus when the plug 36 is advanced inward by turning the same as described above, the end surface 53 will engage the bare surface 49 of the conductor wire 48 and short it with respect to the body 22. The plug 36 can be advanced inward until the outer insulated side of the wire 48 is pushed against the wall surface 55 of the passage 32 to ensure a firm electrical contact between the plug and the bare surface 49 of the wire 48. To open the switch, the contact plug 36 is turned in the opposite-hand direction to advance it outward to a position where the lower surface 53 no longer engages the bare surface 49 of the wire 48. Current can then flow for the full length thereof and into the wire 17 that leads to the detonator 18.

Figure 3:
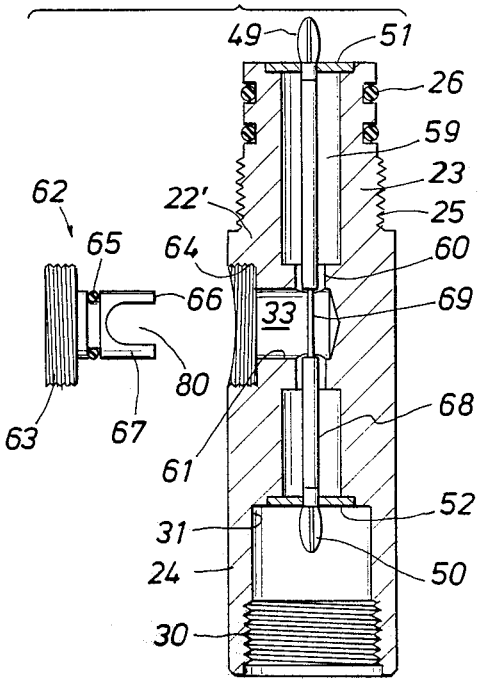
FIG. 3 is a sectional view similar to FIG. 2 showing another embodiment of the present invention.

Another embodiment of the present invention is shown in FIG. 3. Elements that are identical to those previously described have been given the same reference numbers. In this embodiment the passage 59 is concentric with the axis of the body 221, and has a reduced diameter mid-portion 60 that is intersected by the side opening 33. The inner portion 61 of the opening 33 is enlarged somewhat in diameter, and the contact plug 62 has an integral threaded flange 63 at its outer end which is arranged to be received in a threaded counterbore 64 of the body 22', the threads on the flange 63 and in the counterbore 64 providing an axial cam means. For convenience of illustration, the contact plug 62 is shown at 90° with respect to its actual orientation when installed in the body opening 33. The mid-section of the plug 62 has an external recess which receives an O-ring seal 65 that sealingly engages the wall of the inner portion 61 of the opening 33.

Figure 4:
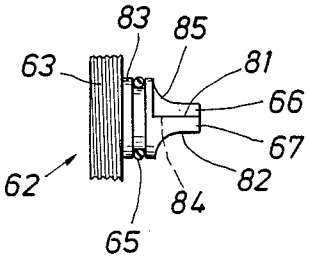
FIG. 4 is a view from a different direction of the contact plug of FIG. 3 to illustrate further detail thereof.

The inner section of the plug 52 is provided with spaced apart legs 66, 67 which define an opening 80 therebetween. As illustrated in FIG. 4, which is enlarged somewhat and shows the plug 62 rotated 90° from its position shown in FIG. 3, the leg 67 has a flat front wall surface 81 that lies in a horizontal plane through the longitudinal axis of the plug 62, and a rear surface 82 that curves outward to the outer diameter of the mid-section 83. The opposite leg 66 is similarly shaped, except that its rear surface 84 lies in such horizontal plane, and the front surface 85 curves outward to the diameter of the mid-section 83.

As shown in FIG. 3, the conductor wire section 68 has the insulation removed completely around it for a length 69 approximately equal to the diameter of the inner opening 61, so that the legs 66, 67 straddle such bare portion 69 when the contact plug is positioned in the opening 33.

In the "open" position of the bypass switch embodiment illustrated in FIG. 3, the contact plug 62 is rotationally oriented such that the bare wire portion 69 does not touch either of the legs 66, 67 but extends with equidistant spacing therebetween. To close the switch, the plug 62 is rotated by a hand-held instrument through a small angle, as previously described, until the edges of the surfaces 82, 85 on the respective legs 66, 67 touch opposite sides of the bare wire portion 69 to short the wire to the body 221 of the switch. Suitable indicia (not shown) can be provided including alignment marks on the exterior surface of the body 221 and the flange 63 of the plug 62 to show at what angular position the switch is "open" or "closed". Suitable stops (not shown) also can be provided in the open and closed positions to ensure that the bare section 69 is not yielded as the switch is operated.

Figure 5:
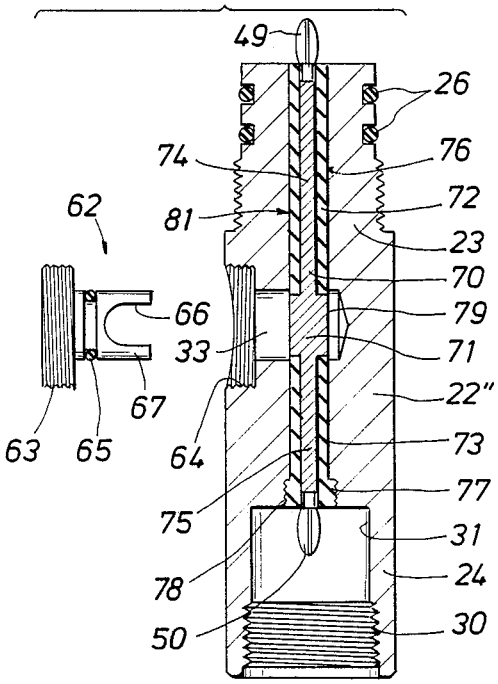
FIG. 5 is a longitudinal sectional view of a third embodiment of the present invention.

Still another embodiment of the present invention is shown in FIG. 5. In this example, the conductor wire section 70 is formed as a relatively rigid rod having an enlarged diameter center portion 71. Connectors 49 and 50 are secured to the respective opposite ends of the rod 70, and non-conducting plastic sheaths, 72, 73 are provided on the respecting outer sections 74 and 75 thereof. The sheath 74 fits snugly inside the upper section 76 of the passage 81, and has an outer diameter substantially equal to the outer diameter of the center portion 71. The sheath 75 is similarly shaped, but has an outwardly directed threaded flange 77 at its outer end which is secured in a threaded counterbore 78 in the body 221. The contact plug 62 having depending legs 66, 67 is identical in construction to that arrangement shown in FIGS. 3 and 4, and thus need not be further described. In the "open" position of the switch shown in FIG. 5, there is clearance between all walls defining the inner peripheries of the legs 66, 67 and the external cylindrical surface 79 of the conductor section 71. To close the switch, the plug 62 is rotated through a small angle to bring edges of the legs 66, 67 into contact with adjacent outer surfaces of the section 71, thereby providing a short between the conductor rod 70 and body 221. As in previous embodiments, and O-ring 65 sealingly engages the wall of the opening 33 to prevent fluid leakage.

To assemble the embodiment shown in FIG. 5, the contact plug is first engaged in the side opening 33 and rotationally oriented such that the opening 80 between the legs 66, 67 is aligned with the longitudinal axis of the body 221. Then the conductor assembly 70, 72, 73 is inserted through the body passage and secured by the flange 77 as shown.

A further embodiment of the switch assembly according to the present invention is shown in FIGS. 6 and 7. Tubular metallic body 86 has a central bore therethrough with enlarged diameter bore portions 87 and 88 at opposite ends thereof. A metal contact plug 89 is threaded into a lateral counterbore 90 that communicates with the central bore and has a reduced diameter inner portion 91 with an inner contact surface 92 similar to the embodiment shown in FIG. 2.

A conductor wire or rod 93 has opposite end portions covered with insulator sleeves 94 and 95. A suitable female contact assembly 96 is received within the enlarged diameter end portion 88 and is connected to wire 93. A frustoconical insulator washer 97 fits against shoulder 98. The contact assembly 96 has an elongated socket 99 (shown in phantom lines) that is adapted to receive a prong of a companion electrical connector (not shown).

Fitting within the oppositely disposed enlarged diameter portion 87 is an insulator sleeve 100 and an insulating washer 101, the washer being received on the externally threaded end portion 102 of the conductor rod 93. A metallic nut 103 is threaded onto the end portion 102 and bears against the insulator washer 101. An electrically conductive coil spring 104 has its outer end in contact engagement with an inner contact surface of a circular base 105, and its inner end portion in contact engagement with outer surfaces of the nut 103. The base 105 has an integral contact pin 106 extending downwardly therefrom. An insulator washer 107 fits over the pin 106 and is secured within the enlarged diameter bore portion 87 by a split retaining ring 108 that is received within an internal annular groove 109 in the body 86. The contact pin 106 is adapted to be received within a suitable socket of a mating electrical connector (not shown).

Assembly of the conductor wire 93 within the body 86 is easily accomplished by first fitting the conductor wire 93 and the female contact member 96 within the central bore and the enlarged diameter end bore portion 88, and then securing the nut 103 onto the threaded end 102 of the conductor wire 93 so that the nut tightens against the washer 101. Then the non-conductive sleeve 100 is placed in the bore portion 87, and the conductor spring 104, the base 105 and the washer 107 are inserted. Finally the split retainer ring 108 is positioned within the groove 109 to limit outward movement of the contact pin 106. Rotation of plug 89 in one hand direction will cause the end surface 92 to contact the base portion of the conductor wire 93 and thereby ground the conductor wire 93 to the body 86. Rotation of the plug 89 in the opposite hand direction will break the ground and arm the device. A suitable seal such as an O-ring 110 engages the wall surface between the counterbore 90 and the central bore of the body 86, and prevents leakage of well fluids into the body 86.

A schematic diagram which shows an overall equivalent electrical circuit in which the present invention is used is shown in FIG. 8. The equivalent circuit is applicable specifically to the embodiment illustrated in FIGS. 6 and 7, however the circuit is applicable generally to all the embodiments disclosed herein. The dash-line box 110 represents the bypass safety switch of the present invention and the dash-line box 111 represents the explosive well tool The contact plug resistance $R_e$ has a measured value of about 0.001 ohm, and the resistance $R_s$ of the spring 104 has a measured value of about 0.052 ohm. The resistance $R_o$ of a typical detonator fuse is about 1.0 ohm. Letting $I_f$ equal the detonator fuse current, and letting I equal the cable current, it can be demonstrated that the fuse current $I_f$ is equal to the product of $R_e$ and I, divided by the sum of the contact spring resistance $R_s$ and the fuse resistance $R_o$. Stated another way, the cable current I is equal to the fuse current $I_f$ times the sum of the contact spring resistance $R_s$ and the fuse resistance $R_o$ divided by the bypass switch contact resistant $R_e$.

It should be noted that the combination of $R_e$ and $R_s$ is such that, even if the detonator fuse resistance is zero, the cable current I would be bypassed through the safety switch in a ratio of 52:1. In practice, however, the current bypass is much better due to the non-zero resistance of the fuse, or any other resistance that is added in series therewith such as the spring contact resistance. The most commonly used detonator fuses have a resistance of from 1.1 to 0.96 ohms. The approximate amount of current need to fire the fuse detonator is 0.5 to 0.8 amps. Current levels of 0.2 amps and below will not cause firing.

From the above expressions of the relationship between cable current, fuse current, and circuit resistances, it will be apparent that when the bypass safety switch is closed, there must be a stray cable current of at least 210 amps to produce a fuse current of 0.2 amps. In other words, the bypass safety switch of the present invention affords protection up to a very high stray current limit of about 210 amps. Any stray current less than this level can not produce a detonation of the explosive well tool.

OPERATION

In operation, a switch 13 in accordance with any disclosed embodiment of the present invention is connected to the upper end of the body of the explosive well tool 10 by engaging the threads 30 therewith. Before the cable head 14 is connected to the opposite end of the switch body 22, the contact plugs 36, 62, or 89 are manipulated to the "closed" or "safe" position to short the conductor to the body. Then, and only then, is the cable head 14 connected to the male end sections 23 of the body. The tool 10 is then raised to the vertical by the cable 15, and lowered into the top of the well conduit 12 until the switch 13 is located just above the rig floor 20, where lowering is halted. During all such assembly and handling, stray electrical current from any source, or any static charge induced in the cable for any reason, will be shorted to ground through the contact plugs 36, 62, or 89 and can not flow at a high enough level to the detonator 18 to cause firing. Thus the risk of premature or accidental firing of an explosive charge 11 in the tool 10 during rigging-up and placement of the tool in the well is greatly reduced, if not eliminated altogether.

With the tool 10 stopped in the position shown in FIG. 1, an operator places the switch 13 to the "open" or "armed" position by rotating the plugs 36, 62, or 89 as described. At this point in time, the explosive charge 11 is well below the rig floor 20, and even if the explosive should go off prematurely, there would be little likelihood of an injury to personnel. With the switch 13 in the "armed" position, the wireline tool is lowered into the well to the selected depth where the explosive 11 is to be fired, and the explosive detonated by the main switch in the service truck.

It now will be apparent that a new and improved bypass safety switch has been disclosed for the purpose of preventing premature or accidental firing of an explosive well tool. Since various changes or modifications can be made in the disclosed embodiments without departing from the inventive concepts involved, it is the aim of the appended claims to cover all such changes and modifications falling within the true spirit and scope of the present invention.

What is claimed is:

1. A safety switch apparatus for use in preventing accidental or premature detonation of an explosive well tool that is adapted to be suspended in a well on an armored electric cable, comprising: a hollow tubular body having a radial opening through the wall thereof; an insulated conductor extending through the interior of said body and adapted for providing the electrical connection between the armored electric cable and an explosive well tool, said conductor having a bare surface; contact means mounted on said body and arranged in operative association with said opening for movement between a first position engaging said bare surface to short said conductor to said body and thereby prevent accidental or premature detonation of the explosive well tool, and a second position disengaged from said bare surface to enable the explosive well tool to be fired.

2. The apparatus of claim 1 wherein said contact means includes an elongated plug mounted in said opening; and further including axial cam means on said plug and said body for moving said plug between said first and second positions in response to rotation of said plug relative to said opening.

3. The apparatus of claim 2 further including coengageable means on said plug and said body for preventing fluid leakage past said plug.

4. The apparatus of claim 2 wherein said plug has recess means on its outer end for enabling rotation of said plug by a hand tool.

5. The apparatus of claim 2 wherein said plug has an end surface engageable with said bare surface of said conductor in said first position, there being lateral clearance between said end surface and said conductor in said second position.

6. The apparatus of claim 2 wherein said plug has a pair of spaced-apart legs on its inner end portion, said legs each having an edge surface engageable with said bare surface of said conductor in said first position, there being clearance between said legs and said conductor in said second position.

7. The apparatus of claim 2 wherein the hollow interior of said body has a central region that is radially offset with respect to the longitudinal axis of said body to provide a thickened wall section of said body through which said opening extends.

8. The apparatus of claim 7 wherein said bare surface is provided only on the side of said conductor which faces said plug, said conductor having insulation on the side thereof opposite said bare surface.

9. The apparatus of claim 8 wherein said body has an external counterbore at the outer end of said opening; said axial cam means on said body being formed on a ring which is secured in said counterbore.

10. The apparatus of claim 2 wherein the hollow interior of said body has a reduced diameter portion that is intersected by said opening, said conductor extending axially through said reduced diameter portion.

11. The apparatus of claim 10 said body has an external counterbore at the outer end of said opening, said axial cam means on said body being formed on wall surfaces of said counterbore.

12. The apparatus of claim 2 wherein said conductor has an enlarged diameter cylindrical section between its ends which is positioned adjacent said opening, said cylindrical section being free of insulation to provide said bare surface.

13. The apparatus of claim 12 further including first insulator means on said conductor extending from said cylindrical section to one end of said body; and second insulator means extending from said cylindrical section to the other end of said body; said second insulator means being fixed to said body to hold said conductor in place within the interior of said body.

14. The apparatus of claim 13 further including pin connection means fixed to the opposite ends of said conductor for making electrical connections with adjacent conductor wires.

15. The apparatus of claim 2 wherein said body has opposite end sections, and further including plate means mounted within each of said opposite end sections of said body; and pin connector means mounted on each of said plate means, said conductor extending between and electrically connected to said pin connector means.

16. A safety switch apparatus for use in preventing accidental or premature detonation of an explosive carried on a wireline well tool coupled to an armored electrical cable, said cable having a conductor and adapted to be attached to the well tool above the explosive at a location that is accessible to an operator comprising: a hollow tubular body having a side opening through the wall thereof; an insulated electrical conductor extending through the interior of said body and adapted for providing an electrical path between said conductor in said armored electrical cable and a firing means for said explosive, said insulated conductor having surface means thereof exposed adjacent said side opening; and means mounted in said side opening and arranged for movement between a first position in electrical contact with said surface means to short said electrical conductor to said body and thereby prevent accidental or premature detonation of said explosive, and a second position out of electrical contact with said surface means to allow said explosive to be fired.

17. The apparatus of claim 16 wherein said surface means of said insulator conductor that is exposed adjacent said lateral opening is constituted by a bare area of said insulated conductor.

18. The apparatus or claim 16 wherein said tubular body has a central bore with enlarged diameter portions adjacent opposite ends thereof, said side opening communicating with said central bore at a location between said enlarged diameter portions; and electrical connector means mounted within each of said enlarged diameter bore portions that is adapted to be connected to said armored electrical cable.

19. The apparatus of claim 18 wherein said insulated conductor has an externally threaded end portion that extends into one of said enlarged diameter portions; and nut means threaded onto said externally threaded end portion for mounting said insulated conductor in said body.

20. The apparatus of claim 19 further including an electrical contact, and a conductive coil spring within said one enlarged diameter portion and extending between said nut means and said electrical contact to provide an electrical connection between said insulated conductor and said electrical contact.

21. The apparatus of claim 20 including an insulator sleeve surrounding said coil spring.

22. The apparatus of claim 21 wherein said electrical contact includes a conductive base having a pin member extending outwardly thereof, said insulation sleeve having an outer end portion, said base fitting within said outer end portion of said insulator sleeve and being engaged by said spring; and retainer means for limiting outward movement of said base.

23. In a well tool assembly carrying an explosive and adapted to be lowered into a well bore on an armored electrical cable to enable the explosive to be detonated at a predetermined depth, a safety switch assembly adapted to be mounted on said well tool above said explosive, said safety switch assembly including a hollow conductive body having a side opening through the wall thereof; an insulated electrical conductor extending through the interior of said body for providing an electrical connection between said armored electrical cable and said well tool, said conductor having an uninsulated portion located adjacent said side opening; and selectively operable means mounted in said side opening for movement between a first position in electrical contact with said uninsulated portion to short said electrical conductor to said body and thereby prevent the explosive from being detonated, and a second position out of electrical contact with said uninsulated portion to enable the explosive to be detonated.

24. The combination of claim 23 wherein said contact means is manually operated and includes an externally threaded plug threaded within said side opening and adapted to be rotated to cause said movement.

25. A method of preventing accidental or premature firing of an explosive well tool that is adapted to be lowered into a well conduit on an armored electric cable, said cable being terminated adjacent said well tool by a cable head, comprising the steps of: attaching a conductive tubular body having a hollow interior between said cable head and the upper end of said explosive well tool, said body having an insulated conductor extending therethrough for providing current flow from said cable to said well tool; shorting said conductor to said body prior to attaching said cable head thereto; positioning said explosive well tool in the upper portion of said well conduit and lowering said well tool until only said tubular body is located above the said upper portion of said well conduit; and then disabling said short between said conductor and said tubular body to permit said explosive well tool to be fired.

26. The method of claim 25 wherein said shorting step is carried out by advancing a metallic contact on said body inwardly thereof until said contact engages a bare surface of said conductor.

27. The method of claim 26 wherein said disabling step is carried out by advancing said contact outwardly of said body to cause said contact to disengage from said bare surface of said conductor.

* * * * *